United States Patent [19]

Fukuoka et al.

[11] Patent Number: 4,475,487

[45] Date of Patent: Oct. 9, 1984

[54] JOINT-PIPE FOR CARBURETOR

[75] Inventors: Takashi Fukuoka, Fuchu; Yoshiaki Nagao, Tokyo, both of Japan

[73] Assignee: Kioritz Corporation, Tokyo, Japan

[21] Appl. No.: 445,407

[22] Filed: Nov. 30, 1982

[30] Foreign Application Priority Data

Dec. 4, 1981 [JP] Japan ..... 56-180121[U]

[51] Int. Cl.[3] ..... F02B 33/04; F02M 9/10

[52] U.S. Cl. ..... 123/73 V; 123/52 M; 123/73 A; 261/62; 261/DIG. 68

[58] Field of Search ..... 123/73 V, 73 A, 73 R, 123/52 M; 261/62, DIG. 68

[56] References Cited

U.S. PATENT DOCUMENTS

| | | | |
|---|---|---|---|
| 2,549,478 | 4/1951 | Kiekhaefer | 123/73 V |
| 2,616,403 | 11/1952 | Kiekhaefer | 123/73 V |
| 3,353,525 | 11/1967 | Nutten . | |
| 3,561,414 | 2/1971 | Schou . | |
| 3,592,173 | 7/1971 | Frehe | 123/52 M |
| 3,746,320 | 7/1973 | Van Camp et al. . | |
| 3,917,762 | 11/1975 | Herbrandson | 123/73 V |
| 4,178,685 | 12/1979 | Inaga . | |
| 4,178,888 | 12/1979 | Jaulmes | 123/73 V |
| 4,228,770 | 10/1980 | Boyesen | 123/73 A |
| 4,354,461 | 10/1982 | Heismann et al. | 123/73 A |

FOREIGN PATENT DOCUMENTS

| | | | |
|---|---|---|---|
| 453602 | 12/1948 | Canada | 123/73 R |
| 616204 | 7/1935 | Fed. Rep. of Germany | 123/52 M |
| 1137080 | 1/1957 | France | 123/56 B |
| 2005766 | 4/1979 | United Kingdom | 123/73 R |

*Primary Examiner*—Wendell E. Burns

*Attorney, Agent, or Firm*—Karl W. Flocks; Sheridan Neimark

[57] ABSTRACT

A crank-case pre-compression type 2-cycle engine internal combustion has an intake opening formed in the wall of a crank case and provided with a reed valve therein, and a carburetor disposed at a rearward offset from the intake port. The carburetor is connected to the inlet port through a joint-pipe. The joint-pipe has a mixture passage formed therein, an intermediate contracted portion and a partition plate extending along the axis of the mixture passage. The portion of the mixture passage near the outlet opening thereof is curved to cross the intake port substantially at a right angle to the latter.

1 Claim, 7 Drawing Figures

JOINT-PIPE FOR CARBURETOR

BACKGROUND OF THE INVENTION

The present invention relates to a joint-pipe for a carburetor mounted in a 2-cycle internal combustion engine in which a reed-valve is provided at the suction port formed in a crank case to permit a pre-compression of air-fuel mixture.

In some of 2-cycle internal combustion engines having a small displacement used in portable chain saw or the like apparatus, a reed valve is mounted in a mixture suction port provided in the wall of crank case, in order to permit a pre-compression of the mixture. In such internal combustion engines, it is often experienced that the engine operation is unsmoothed particularly in an extremely low engine speed as in the case of starting up, due to insufficient opening of the reed valve. It is well known to use, in 2-cycle internal combustion engines of the type described, a diaphragm type carburetor for reducing the size. In such carburetor, it is not possible to sufficiently mix the air and fuel with each other, and the fuel undesirably attach to the surface of the wall defining the mixture intake passage to form a liquid film of fuel which flows down along and in contact with the wall surface. This imposes a problem particularly when the carburetor is disposed at an offset to the suction port due to a reason concerning the construction. Namely, in such a case, the intake mixture passage is inevitably bent so that the liquid fuel tends to attach heavily to the outer part of curvature of the bent passage to unsmooth the engine operation.

In some engines of the kind described, two cylinders are arranged horizontally to oppose to each other in such a manner as to make a common use of the crank case and ignition takes place in both cylinders simultaneously so as to reduce the vibration generated in the engine. In such a type of engine, it is essential that a sufficiently mixed air-fuel mixture is sucked towards the center of the crank case, in order to equalized the operating conditions of two cylinders.

BRIEF SUMMARY OF THE INVENTION

Under these circumstances, the present invention aims at providing a joint-pipe for carburetor of a crank-case pre-compression type 2-cycle internal combustion engine, improved to ensure a sufficient mixing of the air-fuel mixture and acceleration of the same and to introduce the mixture substantially at a right angle to the suction port, thereby to eliminate the problems of prior arts stated hereinbefore.

To this end, according to the invention, there is provided a crank-case pre-compression type 2-cycle internal combustion engine having a reed valve mounted in an intake port formed in the wall of a crank case, a carburetor joint-pipe for connecting the intake port to a carburetor which is offset rearwardly from the intake port, the joint-pipe comprising: a mixture passage formed therein and provided with an intermediate contracted portion and a partition plate extending along the axis of the passage, the portion of the mixture passage near the outlet opening thereof being curved to cross the suction port substantially perpendicularly to the latter.

Other objects, features and advantages of the invention will become clear from the following description of the preferred embodiment taken in conjunction with the accompanying drawings.

DESCRIPTION OF THE PREFERRED EMBODIMENT

A preferred embodiment of the invention will be described hereinunder with reference to the accompanying drawings.

A carburetor joint-pipe embodying the present invention is applied to a chain saw provided with a horizontal twin 2-cycle internal combustion engine of simultaneous ignition type, having two cylinders arranged horizontally to oppose to each other.

Figure 1:
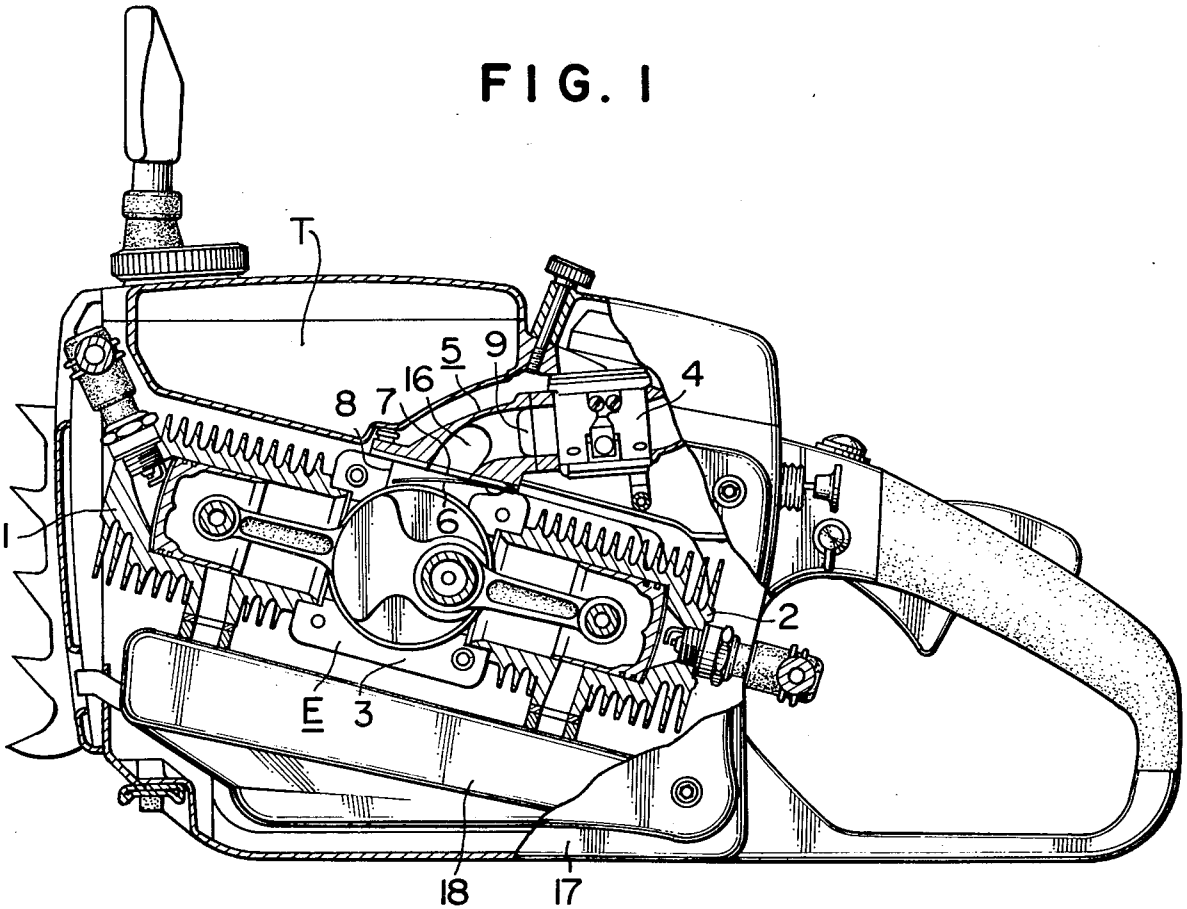
FIG. 1 is a sectional side elevational view of an essential part of a portable chain saw, incorporating a carburetor joint-pipe in accordance with an embodiment of the invention.
Figure 2:
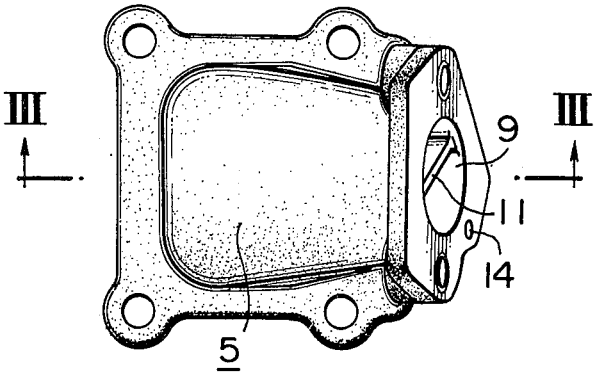
FIG. 2 is a plan view of the joint-pipe.
Figure 3:
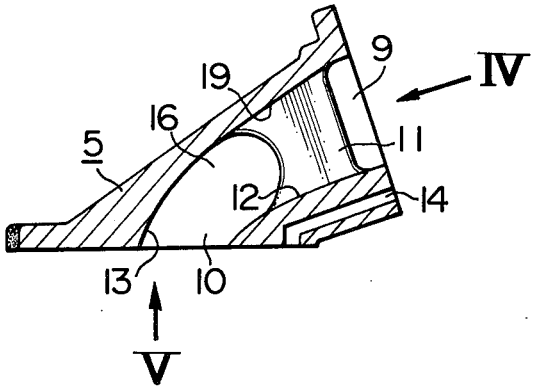
FIG. 3 is a sectional view taken along the line III—III in FIG. 2.
Figure 4:
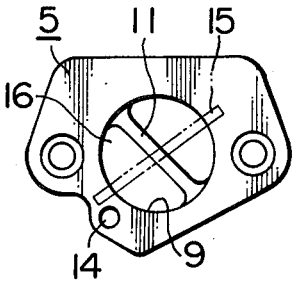
FIG. 4 is a view of the joint-pipe as viewed in the direction of the arrow IV in FIG. 3.
Figure 5:
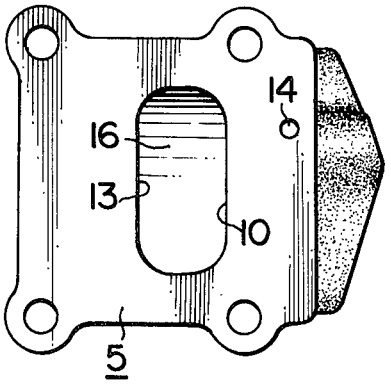
FIG. 5 is a view of the joint-pipe as viewed in the direction of the arrow V in FIG. 3, i.e. the bottom plan view of the joint-pipe shown in FIG. 2.
Figure 6A:
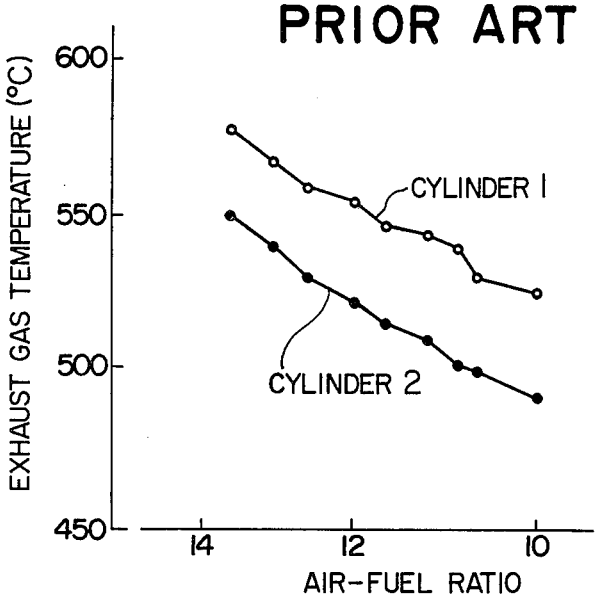
FIG. 6a PRIOR ART
FIGS. 6*a* and 6*b* are graphs showing the result of a test conducted by inventors to examine the exhaust gas temperature of the engine.
Figure 6B:
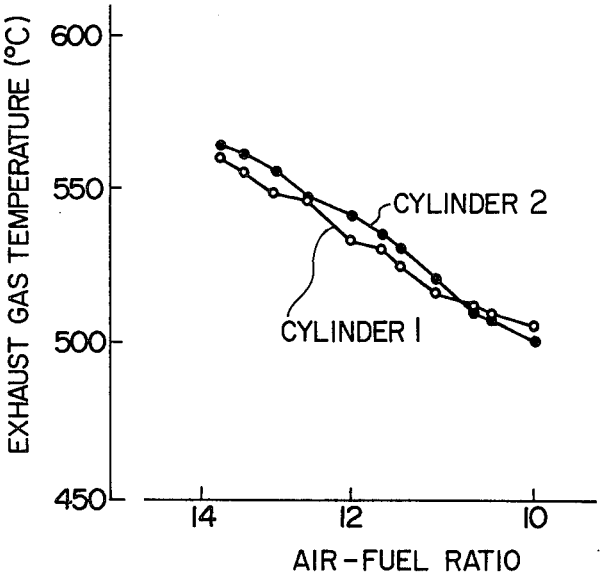

Referring first to FIG. 1 showing in section an essential part of the internal combustion engine, the horizontal twin 2-cycle internal combustion engine E of simultaneous ignition type has a pair of cylinders 1 and 2 arranged at both sides of a crank case 3 to make common use of the latter. These cylinders 1 and 2 are arranged in a machine frame 17 in such a manner that the common axis of the cylinders 1 and 2 extend in the longitudinal direction of the machine frame 17 at a slight forward upward inclination. A fuel tank T and a carburetor 4 are accomodated by a substantially triangular upper space formed above the cylinders 1 and 2, while an exhaust muffler 18 is disposed in the lower triangular space. In this arrangement, a carburetor 4 is offset rearwardly from a mixture intake port 8 provided on the upper side of the crank case 3 and having a reed valve 6. The carburetor 4 is connected to the mixture intake port 8 through a carburetor joint-pipe 5 in accordance with the invention. A mixture passage 16 is disposed in the joint-pipe 5. One end of the mixture passage 16 constitutes a circular inlet opening 9 directly connected to the carburetor 4, while the other end constitutes a substantially rectangular outlet opening 10 which opposes to a base plate opening 7 of the reed valve 6.

A pressure pulsation pick-up passage 14 disposed along the passage 16 is adapted to transmit the pressure pulsation in the crank case 3 to a fuel pump (not shown) attached to the carburetor 4. The mixture passage 16 is contracted at its intermediate portion 12, and a partition plate 11 is extended in the axial direction of the mixture passage 16 so as to extend between the contracted portion 12 and the inlet opening 9. Furthermore, the portion of the upper part 19 of the wall defining the mixture passage 16 near the outlet opening 10 is smoothly curved to form a substantially flat deflector wall 13 which opposes to the leading side of the flow of mixture and connects to the aforementioned base plate opening 7 substantially perpendicularly thereto.

According to this arrangement, the flow of mixture coming from the carburetor 4 is split by the partition plate 11 and is then accelerated and mixed as it flows through the contracted portion 12. The mixture flow is then deflected by the deflector wall 13 to rush into the crank case 3 through the base plate opening 7 substantially at a right angle to the latter. It is, therefore, possible to uniformly introduce the mixture to the central region of the crank case 3 without fail, even when the reed valve 6 is not opened sufficiently. Consequently, it becomes possible to avoid any unsmooth engine operation at low speed, and the combustion conditions for two cylinders 1 and 2 are equalized to make sure of the small vibration of operation peculiar to the horizontal two 2-cycle internal combustion engine of simultaneous ignition type.

According to the invention, it is possible to arrange the partition plate 11 at an inclination to the deflecting wall 13 and to intersect the throttle shaft 15 of the carburetor 4. By so doing, the flow of mixture is divided into four components by the throttle valve plate (not shown) and the partition plate 11, and is made to flow past the passage of the carburetor having the throttle valve plate, partition plate 11 and the deflector wall 13 all of which are arranged at different orientations, so that the flow of mixture is made to swirl to attain sufficient mixing and directivity.

In order to confirm the advantage of the invention, a test was conducted with two horizontal twin 2-cycle internal combustion engines each having two cylinders of a displacement of 30 cc each. One of the engines was provided with the pipe-joint in accordance with the invention, while the other was devoid of the pipe-joint of the invention. The engines were operated at 8000 rpm with various air-fuel ratio values of the mixture, and the exhaust gas temperatures were measured at the exhaust ports of respective cylinders. As will be understood from FIGS. *6a* and *6b* showing the result of the test, the conventional engine devoid of the joint-pipe of the invention exhibited a temperature difference as large as about 30° C. between two cylinders. This means that there is an innegligibly large difference of the state of intake mixture between two cylinders. In contrast, the engine incorporating the joint-pipe of the invention showed almost no difference in exhaust gas temperature between two cylinders, and the engine could operate quite smoothly.

From this fact, it will be seen that the carburetor joint-pipe of the invention ensures smooth engine operation by equalizing the condition of mixture supply to both cylinders and improving the mixing of air-fuel mixture.

Although the invention has been described through specific terms, it is to be noted here that the described embodiment is not exclusive and various changes and modifications may be imparted thereto without departing from the scope of the invention which is limited solely by the appended claims.

What is claimed is:

1. In a crank-case pre-compression type 2-cycle internal combustion engine E having a reed valve 6 mounted in an intake port 8 formed in the wall of a crank case 3, a carburetor joint-pipe 5 for connecting said intake port 8 to a carburetor 4 which is offset rearwardly from said intake port 8, said joint-pipe 5 comprising:

an air-fuel mixture passage 16 formed therein and provided with an intermediate contracted portion 12 and a partition plate 11 extending between said contracted portion 12 and an inlet opening 9 of said passage 16 along the axis of said passage 16, the portion of said mixture passage 16 near the outlet opening 10 thereof being curved to cross said suction port 8 substantially perpendicularly to the latter.

* * * * *